US007954939B2

(12) United States Patent
Yamamoto et al.

(10) Patent No.: US 7,954,939 B2
(45) **Date of Patent: *Jun. 7, 2011**

(54) DECURLING MECHANISM

(75) Inventors: Akihito Yamamoto, Wakayama (JP); Yoshitsugu Tokai, Wakayama (JP)

(73) Assignee: Noritsu Koki Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/360,696

(22) Filed: Jan. 27, 2009

(65) Prior Publication Data

US 2009/0190985 A1 Jul. 30, 2009

(30) Foreign Application Priority Data

Jan. 29, 2008 (JP) ..... 2008-018320

(51) Int. Cl.
*B41J 2/01* (2006.01)
*G03G 15/00* (2006.01)

(52) U.S. Cl. ..... 347/104; 347/101; 399/406

(58) Field of Classification Search ..... 347/101, 347/104

See application file for complete search history.

(56) References Cited

U.S. PATENT DOCUMENTS 5,450,102 A 9/1995 Ishida et al.
6,120,199 A * 9/2000 Takekoshi ..... 400/611
2003/0044208 A1* 3/2003 Kouno ..... 399/406
2005/0063746 A1 3/2005 Sugata
2009/0190982 A1* 7/2009 Yamamoto ..... 399/406
2009/0190984 A1* 7/2009 Yamamoto et al. ..... 399/406

FOREIGN PATENT DOCUMENTS

EP 1 288 152 A2 3/2003
EP 1 849 617 A1 10/2007
JP 08012161 A * 1/1996
JP 2008-056655 A 3/2006

OTHER PUBLICATIONS

The Extended European Search Report dated Jun. 7, 2010; Application No. / Patent No. 09000978.8-2304/2085234.

* cited by examiner

*Primary Examiner* — Matthew Luu
*Assistant Examiner* — Kendrick X Liu
(74) *Attorney, Agent, or Firm* — Studebaker & Brackett PC; Donald R. Studebaker

(57) ABSTRACT

A decurling mechanism for performing a decurling process of correcting the curl of paper includes: a first roller; a second roller disposed travelably around the first roller; and a roller position changing mechanism for changing the second roller to a plurality of positions set on a traveling path of the second roller. The plurality of positions include a decurling position in which the decurling process to the paper is enabled and the paper is conveyed while being pinched between the first and second rollers, a conveyance position in which the decurling process to the paper is disabled and the paper is conveyed while being pinched between the first and second rollers and a pinch release position in which the paper is released from the pinch between the first and second rollers.

3 Claims, 12 Drawing Sheets

DECURLING MECHANISM

CROSS-REFERENCE TO RELATED APPLICATION

This application claims priority under 35 USC 119 to Japanese Patent Application No. 2008-018320 filed on Jan. 29, 2008, the entire contents of which are incorporated herein by reference.

BACKGROUND

The techniques disclosed in this specification relate to decurling mechanisms for performing a decurling process of correcting a curl of paper.

In conventional printers used such as for photographic printing systems, their printer body includes a paper containing part for containing a long web of rolled paper (a long rolled paper web). The paper web contained in the paper containing part is fed to a printing part and printed therein by a print head, such as an inkjet print head. The printed paper web is cut in a given length and then conveyed to an output point at which, for example, a paper output tray is disposed.

Since the paper web is rolled around a core, it has a curled shape due to a core set. Therefore, if cut pieces of the curled paper web are conveyed to the output point, such as a paper output tray, as they are, they rob one another such as on the paper output tray upon stacking one on another and their printing surfaces may be thereby likely to get scratched. In addition, the curled cut pieces of paper look ugly. Therefore, there is a demand to correct curls of printed pieces of paper to flatten it out prior to presentation to customers.

To meet the above demand, an example of conventional printers includes a decurling mechanism for decurling pieces of paper (correcting the curls of the pieces of paper) and the decurling mechanism is configured to decurl a piece of paper by bending it so that its rising side comes inside (see, for example, Published Japanese Patent Application No. 2006-56655).

SUMMARY OF THE DISCLOSURE

For such kind of printers used in photographic printing systems, an increasing trend is a configuration capable of not only feeding a rolled paper web and printing it but also feeding previously cut paper sheets of given size through a manual paper feed tray and printing them. In recent years, various types of photo printing service shops have appeared. Among them, small-sized shops efficiently use printers having the above configuration by using a rolled paper web for a frequently used size and using paper sheets for less frequently used sizes. The paper sheets normally have no curl.

If the above decurling mechanism is simply added to the printer such as for the photographic printing system, paper sheets originally having no curl are also subjected to a decurling process, which is unfavorable because the paper sheets are unnecessarily curled oppositely to the curl of a rolled paper web. On the other hand, in order that a rolled paper web is subjected to a decurling process but paper sheets are not subjected to a decurling process, the conveyance path for the rolled paper web and the conveyance path for paper sheets must be separated from each other to sort the two types of paper as described in the above published document. This complicates the printer structure.

Furthermore, the decurling process is normally implemented by pressing a decurling roller against paper to conform the paper to the roller surface. If the conveyance of paper is stopped during the decurling process, an indentation of the roller is left on the paper. For example, in inkjet printers, paper is intermittently conveyed during image formation. Therefore, the paper conveyance is frequently and temporarily stopped during the decurling process. If an indentation of the decurling roller is left on the paper upon stop of paper conveyance, this invites a problem that the print quality is deteriorated.

The present invention has been made in view of the foregoing points and, therefore, an object thereof is to provide a decurling mechanism that subjects curled paper to a decurling process with a simple structure but does not subject paper with no curl to a decurling process and that can prevent an indentation of a decurling roller from being left on the paper upon stop of paper conveyance during the decurling process.

To attain the above object, what is provided is a decurling mechanism for performing a decurling process of correcting the curl of paper, wherein the decurling mechanism includes: a first roller; a second roller disposed travelably around the first roller; and a roller position changing mechanism for changing the second roller to a plurality of positions set on a traveling path of the second roller, and the plurality of positions includes a decurling position in which the decurling process to the paper is enabled and the paper is conveyed while being pinched between the first and second rollers, a conveyance position in which the decurling process to the paper is disabled and the paper is conveyed while being pinched between the first and second rollers and a pinch release position in which the paper is released from the pinch between the first and second rollers.

With the above configuration, the roller position changing mechanism can move the second roller around the first roller to change the relative position of the second roller to the first roller among the decurling position, the conveyance position and the pinch release position. Thus, whether or not to carry out the decurling process can be selected according to the type of paper conveyed by the first and second rollers.

Specifically, when, for example, a piece of rolled paper is conveyed, the decurling mechanism moves the second roller to the decurling position and subjects the paper to the decurling process, whereby the curl of the paper can be corrected. On the other hand, when, for example, a paper sheet is conveyed, the decurling mechanism moves the second roller to the conveyance position and can convey the paper sheet without subjecting it to the decurling process. Thus, the paper sheet originally having no curl can be prevented from being subjected to the decurling process and thereby being curled. This provides a decurling mechanism that can appropriately handle a piece of rolled paper and a paper sheet.

Furthermore, when the paper conveyance is stopped, the pressing of the second roller against the paper can be released by moving the second roller in decurling process from the decurling position to the pinch release position. For example, when in an inkjet printer the paper conveyance is temporarily stopped owing to intermittent paper conveyance in order to form an image on the paper, the movement of the second roller from the decurling position to the pinch release position can eliminate an inconvenience that an indentation of the second roller is left on the paper and the printing quality is thereby deteriorated.

The second roller is preferably located upstream of the first roller in a direction of paper conveyance when being in the conveyance position.

With the above configuration, a greater clearance is created between the first and second rollers than the case where both the rollers are vertically juxtaposed with respect to the direction of paper conveyance. Thus, the pinching force of both the rollers against the paper can be reduced to reduce the load applied to the paper. Specifically, the paper is conveyed in a slightly sagging state. Therefore, even if the pinching force is reduced, the restoring force of the paper towards stretching straight and the frictional force between the paper and both the rollers provide smooth conveyance of the paper using the resilience of the paper.

Preferably, the decurling position set on the traveling path of the second roller comprises a plurality of decurling positions, and the roller position changing mechanism is configured to adjust the strength of a decurling force applied to the paper by moving the second roller among the plurality of decurling position.

With the above configuration, an appropriate decurling force to the shape of a curl of paper can be applied to the paper by adjusting the strength of the decurling force. Specifically, part of a paper web in the vicinity of the core around which the paper web is rolled has a small radius of curvature and is therefore strongly curled, while part of the paper web in the vicinity of the outer periphery thereof has a large radius of curvature and is therefore weakly curled. To cope with this, the strength of the decurling force is adjusted according to the amount of use of the rolled paper web. Thus, the curl of the paper can be corrected with an optimum decurling force.

Preferably, the first and second rollers are disposed on a conveyance path for paper on which an image is to be printed in an inkjet printer, the inkjet printer includes a printing part for printing an image on the paper on the conveyance path by ejecting ink to the paper and a dryer, disposed downstream of the printing part in the direction of paper conveyance, for drying the ink adhering to the paper by blowing dry air to the paper after being printed by the printing part, and the first and second rollers are disposed downstream of the dryer in the direction of paper conveyance.

With the above configuration, the dryer dries ink adhering to the paper in the printing part. When dried by the dryer, the paper is heated by dry air and is therefore easily deformable. Since, in addition, the first and second rollers are disposed downstream of the dryer in the direction of paper conveyance, the paper can be subjected to the decurling process while held easily deformable. This provides a high decurling effect.

DETAILED DESCRIPTION

A description is given below of example embodiments with reference to the drawings. The following example embodiments are merely illustrative in nature and are not intended to limit the scope, applications and use of the invention.

FIRST EXAMPLE EMBODIMENT

Figure 1:
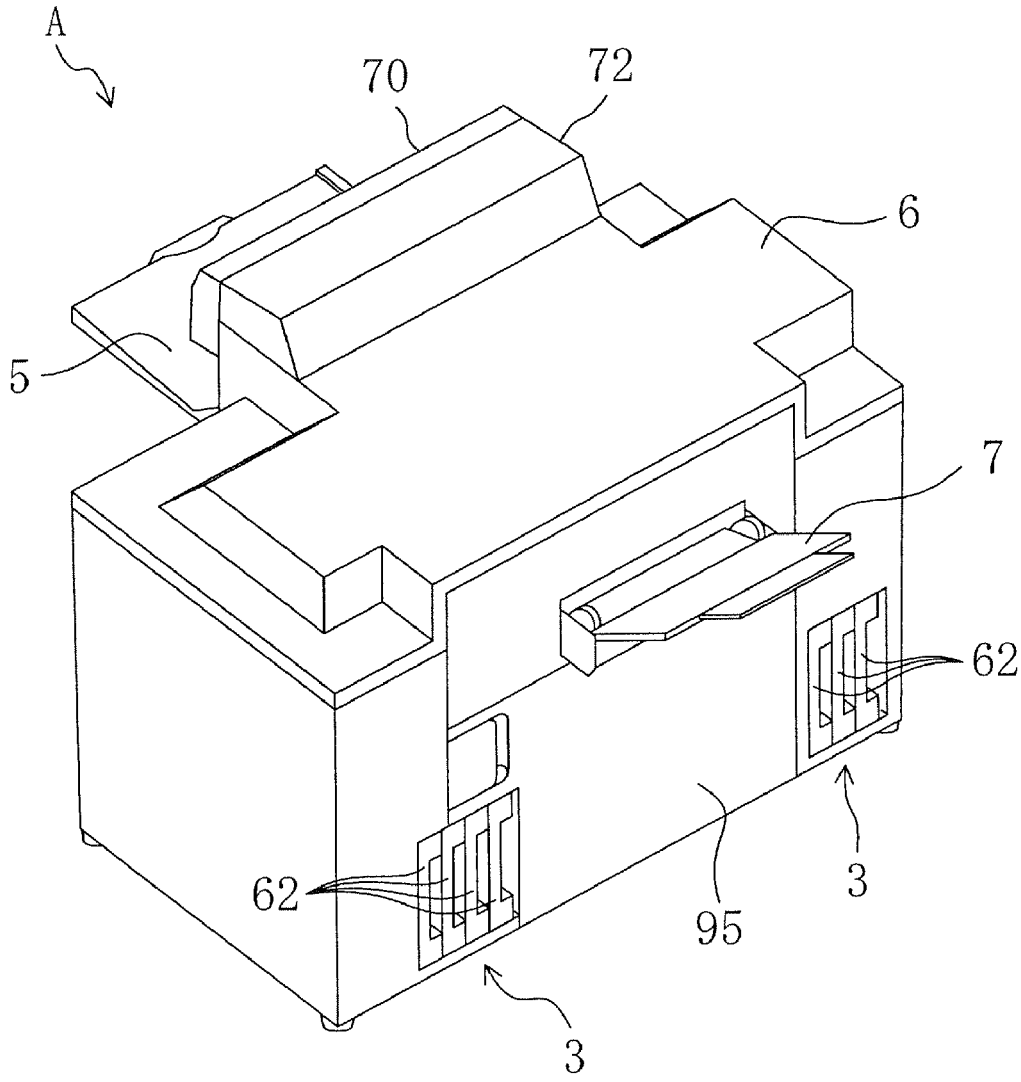
FIG. 1 is a perspective view showing the appearance of an inkjet printer including a decurling unit as a decurling mechanism according to a first example embodiment.
Figure 2:
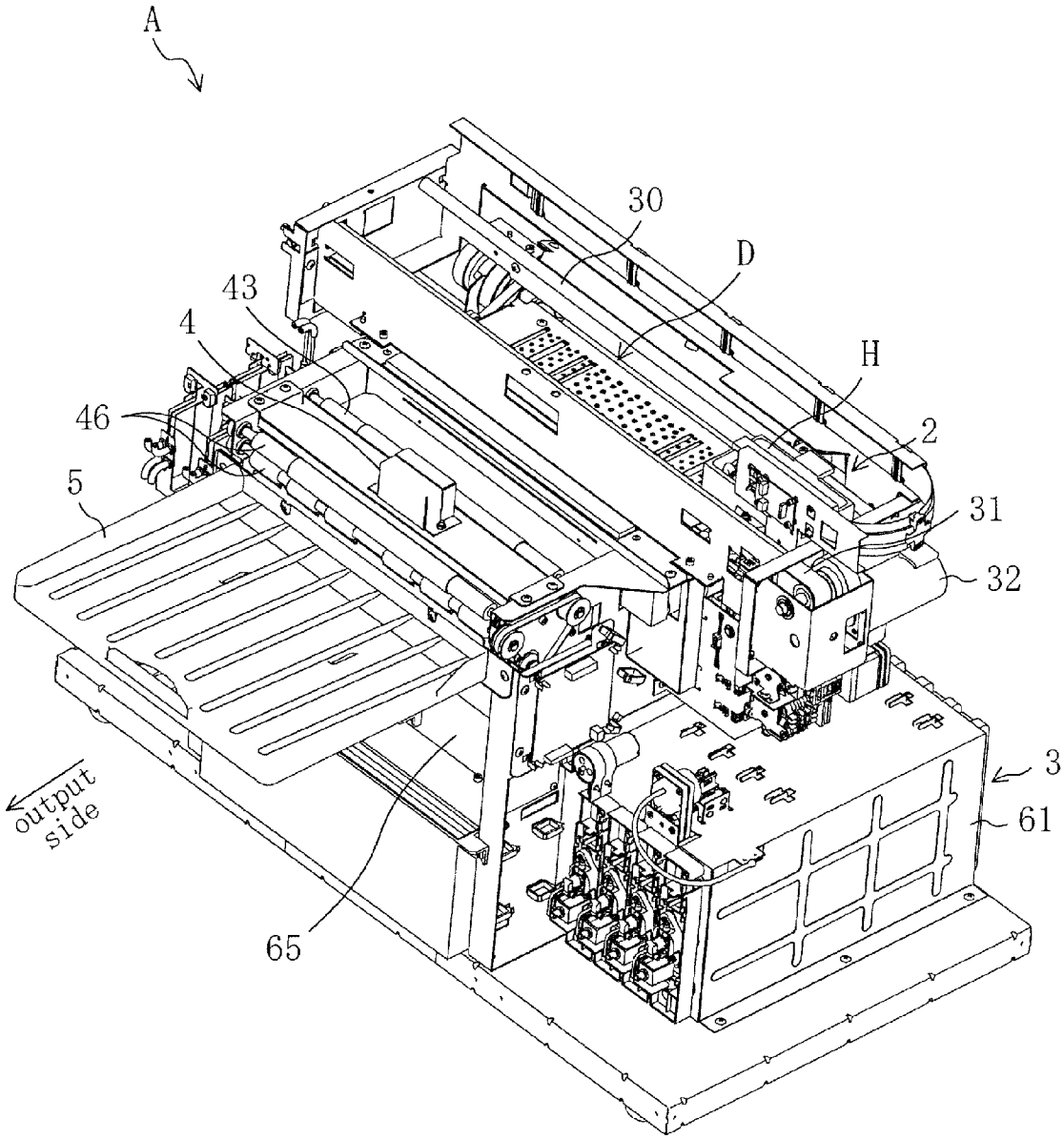
FIG. 2 is a perspective view showing the structure of the inkjet printer inside a housing.
Figure 3:
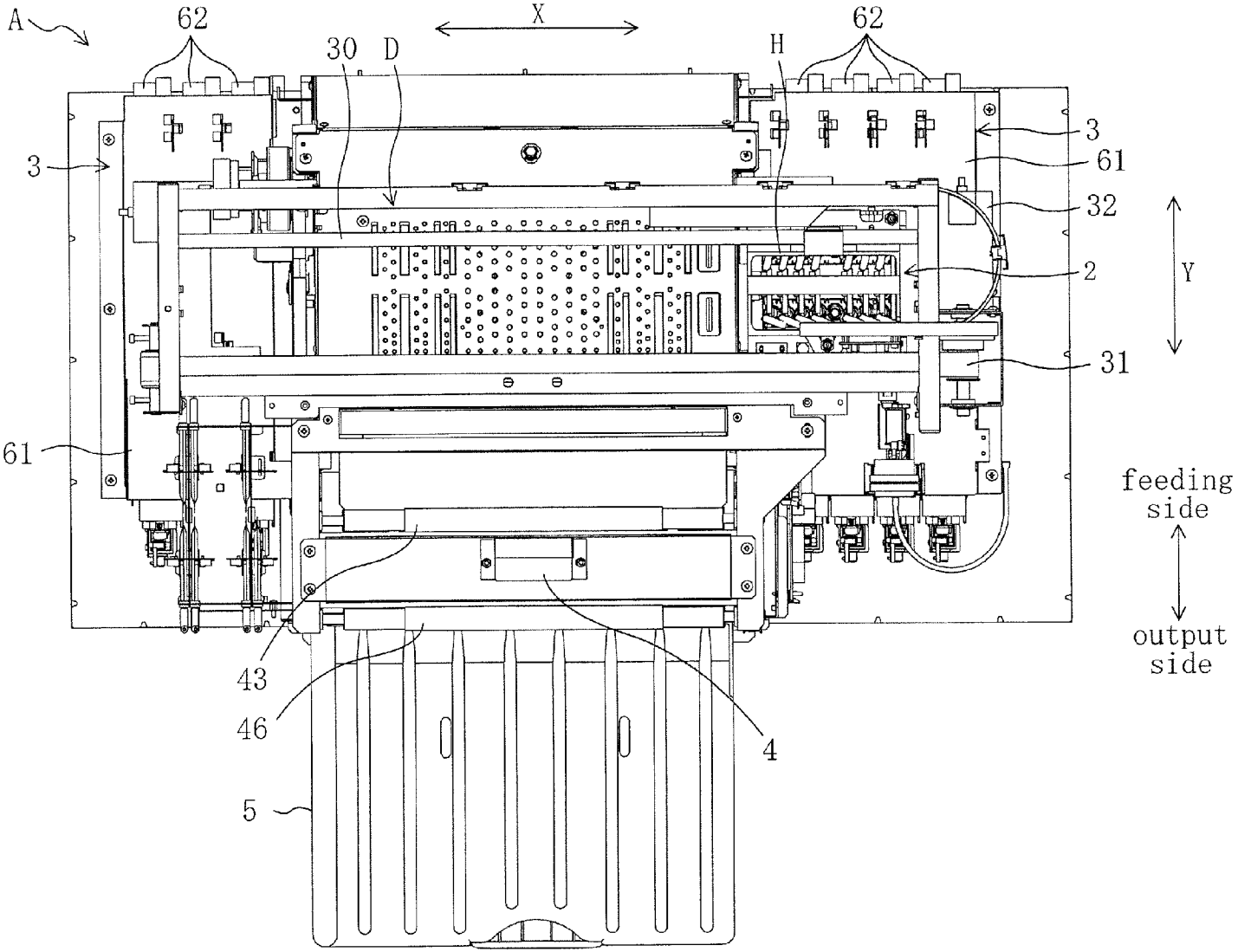
FIG. 3 is a plan view showing the structure of the inkjet printer inside the housing.
Figure 4:
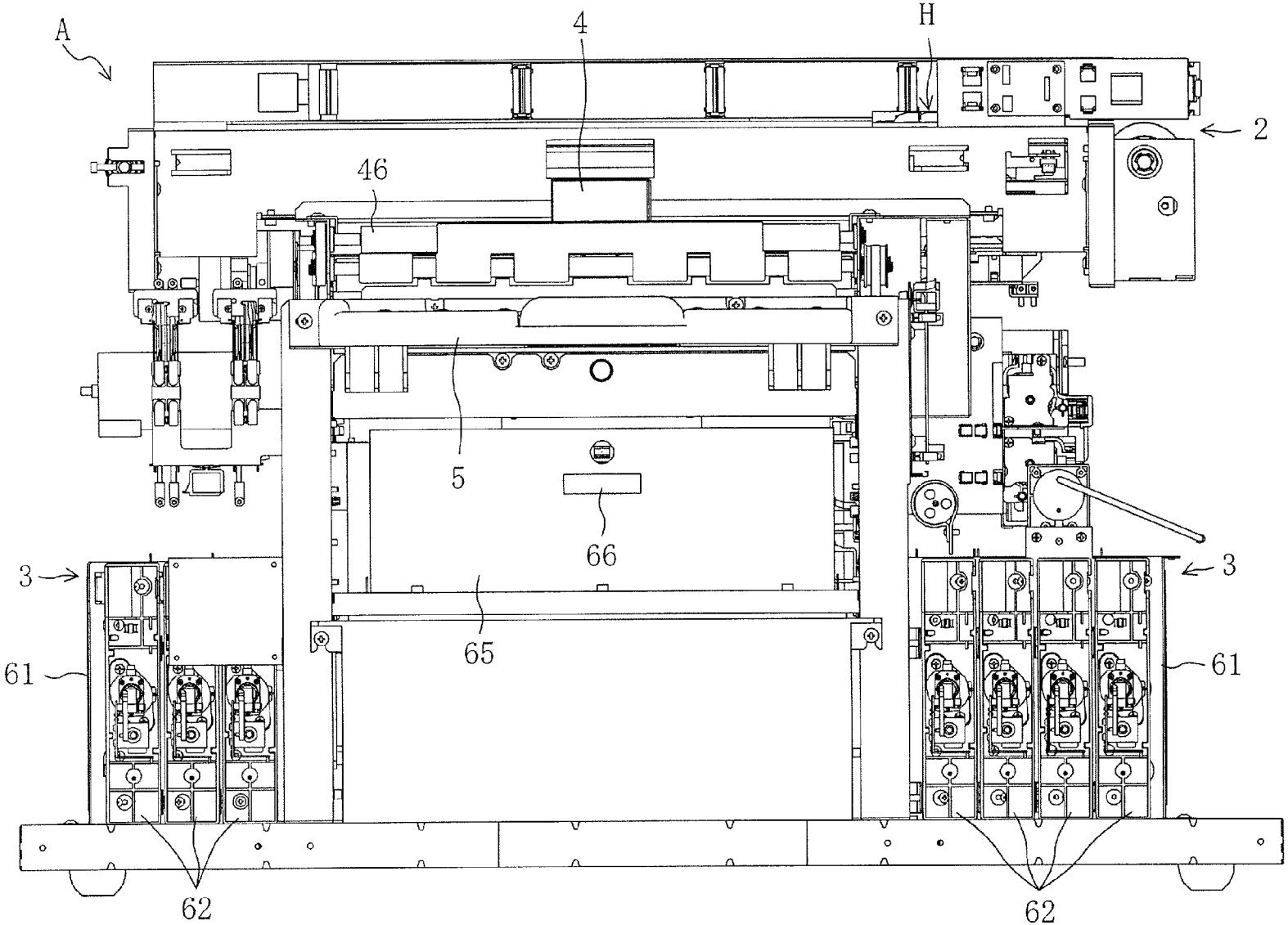
FIG. 4 is a front view showing the structure of the inkjet printer inside the housing.

FIG. 1 shows the appearance of an inkjet printer A including a decurling unit as a decurling mechanism according to a first example embodiment, and FIGS. 2 to 5 show the internal structure of the inkjet printer A. The inkjet printer A is used for a photographic printing system and, for example, used for printing photographic images on printing paper P1 or P2 based on image data transmitted via a communication cable from a reception block for obtaining the image data and correcting it as necessary. More specifically, the inkjet printer A is configured to be capable of performing an automatic printing for pulling out one end of a long roll of printing paper P2 and printing an image on the printing surface of the roll of printing paper P2 (hereinafter, referred to as a paper web P2) and a manual-feed printing for printing an image on the printing surface of a sheet of printing paper P1 (hereinafter, referred to as a paper sheet P1) previously cut in a given size.

When in the following description the paper sheet P1 and the paper web P2 need not be particularly distinguished, they are referred to as printing paper P1 or P2. Furthermore, the printing surface means the surface on which an image is to be printed. The printing surface of each paper sheet P1 is determined when the paper sheet P1 is set on a manual-feed tray 7 (see FIG. 5). Specifically, the printing surface is the side of the paper sheet PI facing upward when the paper sheet P1 is set on the manual-feed tray 7. On the other hand, the printing surface of the paper web P2 is the side thereof facing radially outward when the paper web P2 is rolled.

-General Structure-

As shown in FIGS. 1 to 5, the inkjet printer A includes a printer body 90, a manual-feed tray 7 for manually setting a paper sheet P1 thereon and feeding it therefrom into the printer body 90, and a paper output tray 5 serving as a paper placement part for receiving pieces of printing paper P1 or P2 output from the printer body 90 and placing them thereon.

The printer body 90 includes: a housing 6; a paper roll containing part 1 disposed in a lower part of the interior of the housing 6 and containing a paper web P2 rolled with its printing surface outside; a printing part 2 (see FIGS. 2 and 5), disposed in an upper part of the interior of the housing 6 (above the paper roll containing part 1), for printing based on image data an image on the printing surface of the paper sheet P1 fed from the manual-feed tray 7 or the printing surface of the paper web P2 pulled out of the paper roll containing part 1; ink storages 3, located in the lower part of the interior of the housing 6 on both sides of the paper roll containing part 1, for storing ink to be supplied to the printing part 2; and a roller unit 200, disposed on an upper part of a cover member 95 attached to the housing 6 to be freely opened and closed, for conveying and feeding a paper sheet P1 set on the manual-feed tray 7 towards the printing part 2 when the cover member 95 is closed.

Disposed in the upper part of the housing 6 and downstream of the printing part 2 in the direction of paper conveyance are a roller cutter 41 for cutting out an unnecessary part of printed printing paper P1 or P2, a back printing unit 4 for printing a serial number on the back side of each piece of printing paper P1 or P2, a drying unit U6 for drying the piece of printing paper P1 or P2 printed in the printing part 2, a paper output unit U4 for conveying the piece of printing paper P1 or P2 printed in the printing part 2 further downstream; and a decurling unit U7 for performing a decurling process of correcting the curl of the paper web P2 that is a core set formed by rolling the paper web P2 around the core. Disposed downstream of the decurling unit U7 in the direction of paper conveyance is the paper output tray 5, extending outside from a paper output port 47 in the housing 6, for receiving pieces of printing paper P1 or P2 delivered by the decurling unit U7 and placing them thereon.

Figure 5:
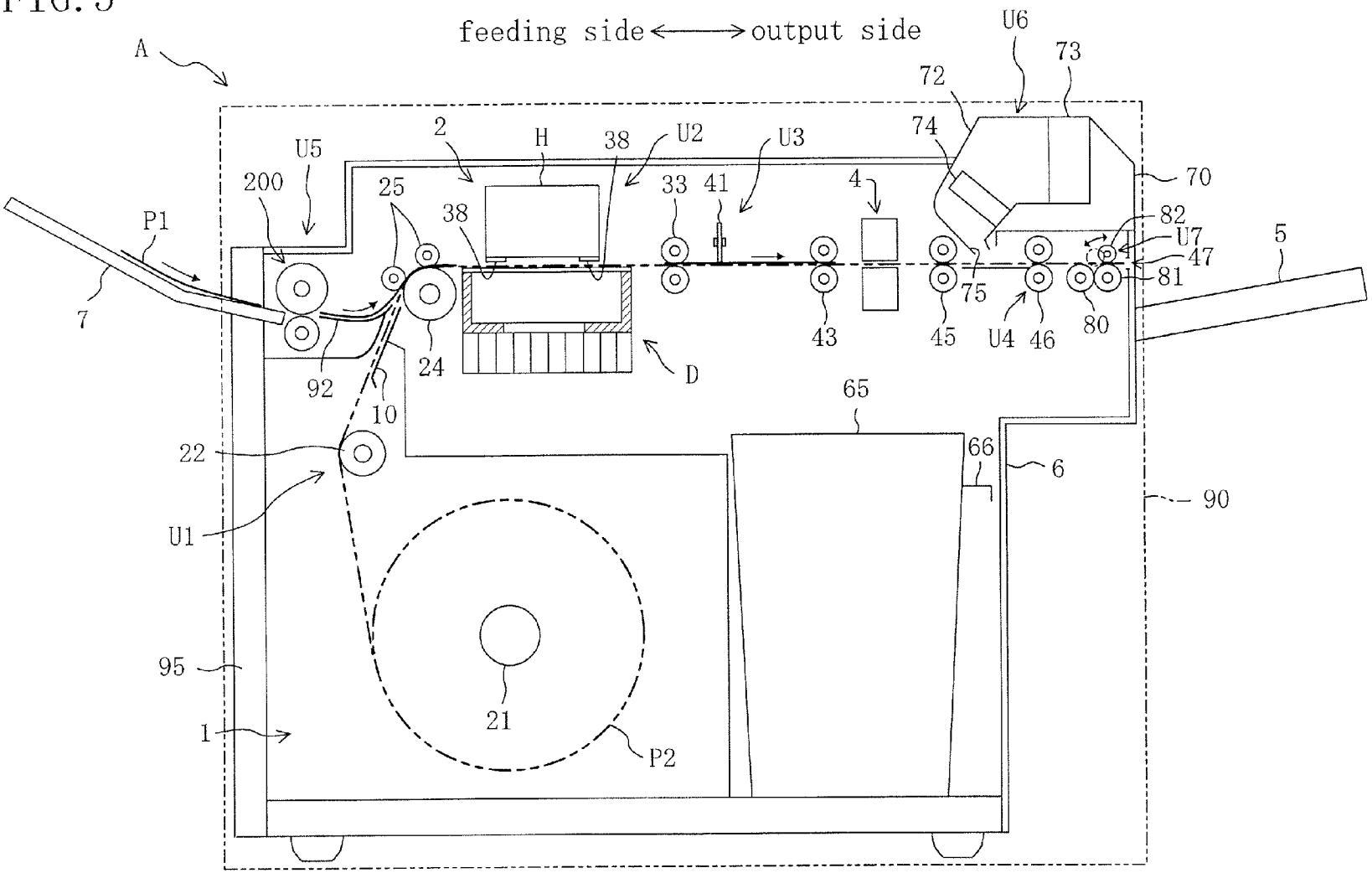
FIG. 5 is a schematic diagram of the inkjet printer when viewed from the left of the housing, showing a conveyance path of printing paper.

Hereinafter, the side of the housing 6 towards the paper output tray 5 ("output side" shown in FIG. 3) is referred to as the housing front side, the side thereof opposite to the paper output tray 5 ("feeding side" shown in FIG. 3) is referred to as the housing rear side, the left side thereof as viewed from the housing front side is referred to as the housing left side, and the right side thereof as viewed from the housing front side is referred to as the housing right side. Therefore, the right-to-left direction in FIG. 5 is the housing front-to-rear direction and the direction orthogonal to the drawing sheet of FIG. 5 is the housing right-to-left direction. The housing right-to-left direction coincides with the width direction of the paper sheet P1 set on and fed from the manual-feed tray 7 and the width direction of the paper web P2 contained in and fed from the paper roll containing part 1.

-Paper Conveyance Mechanism-

As shown in FIG. 5, the inkjet printer A is provided with a paper conveyance mechanism for pulling the leading edge of a paper web P2 out of the paper roll containing part 1 and conveying it along a given paper conveyance path. To form the paper conveyance path, the paper conveyance mechanism includes, in order from the feed unit U1 for feeding a paper web P2, the feed unit U1, a printing unit U2, a cutter unit U3, the drying unit U6, the paper output unit U4 and the decurling unit U7. Thus, image data is printed on the printing surface of the printing paper P1 or P2 located on the paper conveyance path in the printing unit U2 provided in the printing part 2.

In this first example embodiment, for another paper feed path other than the feed path of a paper web P2 from the feed unit U1 to the printing unit U2, the paper conveyance mechanism further includes a manual-feed unit U5 configured to pull in a paper sheet P1 from the manual-feed tray 7 and feed it to the printing part 2.

The paper conveyance mechanism is configured so that, in printing on a paper web P2, the feed unit U1 feeds the paper web P2 set in the paper roll containing part 1 to the printing unit U2, the printing unit U2 then prints image data on the fed paper web P2 with the print head H while conveying the paper web P2. Then, the paper conveyance mechanism coveys the printed paper web P2 to the cutter unit U3, the cutter unit U3 cuts the paper web P2 in a given print size, the drying unit U6 then dries the cut piece of paper web P2, and the paper conveyance mechanism conveys the cut piece of paper web P2 out to the paper output tray 5 while the decurling unit U7 decurls the cut piece of paper web P2. Hereinafter, the upstream side and downstream side in the direction of conveyance of the paper web P2 being conveyed during printing is referred to simply as the upstream side and downstream side, respectively.

The feed unit U1 includes a core roller 21 for winding a paper web P2 in a roll thereon to contain the rolled paper web P2 in the paper roll containing part 1, a transverse restriction roller 22 for restricting the transverse position of the paper web P2 pulled out of the core roller 21, a conveyance drive roller 24 capable of being driven into rotation by an unshown electric motor to convey the paper web P2, and two pinch rollers 25 opposed to the conveyance drive roller 24 and engageable against the conveyance drive roller 24 to pinch the paper web P2 together with the conveyance drive roller 24.

The feed unit U1 is configured to pull the paper web P2 out of the paper roll containing part 1 and also feed it to the printing part 2 by the rotation of the conveyance drive roller 24.

The conveyance drive roller 24 is configured to be rotated forward by an unshown electric motor to pull the paper web P2 out of the paper roll containing part 1 and feed it to the printing part 2 and rotated backward by the electric motor to return the paper web P2 to the paper roll containing part 1.

Thus, the inkjet printer A can cut off the printed part of the paper web P2 into a given size by the cutter unit U3 downstream of the printing part 2, then return the remaining paper web P2 after the cutting upstream and restart printing with the leading edge of the remaining paper web P2 or can return the paper web P2 after the cutting into the paper roll containing part 1, feed a paper sheet P1 to the printing part 2 through the manual-feed unit U5 and print on it. Furthermore, in replacing the paper web P2 with new one, part of the paper web P2 pulled out of the paper roll containing part 1 can be returned into the paper roll containing part 1.

The printing unit U2 includes: the print head H for ejecting ink to the printing paper P1 or P2 and forming an image on it; a paper holder D for holding by suction the printing paper P1 or P2 at a position allowing printing of the print head H; and a pair of paper conveyance rollers 33 disposed downstream of the paper holder D and engaged against each other. The conveyance drive roller 24 and the pinch rollers 25 in the feed unit U1 are used also as components of the printing unit U2 and act to convey the printing paper P1 or P2 in the printing unit U2.

The print head H is configured to be movable along a rail 30 extending in a main scanning direction X (see FIG. 3) coinciding with the width direction of the printing paper P1 or P2 (i.e., the housing right-to-left direction). Specifically, when the rotational force of a drive motor 32 is transmitted through a pulley to a drive belt 31, the print head H moves in the main scanning direction X according to the amount of rotation of the drive belt 31.

The print head H further includes two head units 38 and 38 (see FIG. 5) arranged along a sub-scanning direction Y (see FIG. 3) orthogonal to the main scanning direction X and coinciding with the direction of travel of the printing paper P1 or P2 (i.e., the housing front-to-rear direction). The print head H is configured to print a given image or characters on the printing paper P1 or P2 by ejecting ink through ink-jet nozzles (not shown) formed in these two head units 38 and 38.

The printing paper P1 or P2 is intermittently (stepwise) conveyed in certain unit amounts of conveyance in the sub-scanning direction Y by the conveyance drive roller 24, the pinch rollers 25 and the paper conveyance rollers 33. During each stopping time of the printing paper P1 or P2 in the course of intermittent conveyance, the print head H scans one way (makes a forward scanning or a backward scanning) in the main scanning direction X. During the scanning, ink is concurrently ejected through the ink-jet nozzles of each head unit 38 to the printing surface (top surface) of the printing paper P1 or P2. In other words, after a single scanning of the print head H, the printing paper P1 or P2 is conveyed by a unit amount of conveyance and the print head H then scans once. By repeating this operation, a desired image is printed.

The ink storages 3 include their respective box-shaped cases 61 (see FIG. 4) disposed on the right and left of the inkjet printer A. These cases 61 contain seven removable ink cartridges in total (in FIG. 4, three in the left case 61 and four in the right case 61). The ink cartridges 62 are charged with different types of ink having different hues. Therefore, the ink cartridges 62 spent or being used can be replaced with new ones by removing them from the cases 61 and setting new ones in the cases 61. Seven types of ink charged in these ink cartridges 62 are yellow (Y), magenta (M), cyan (C), black (K), red (R), violet (V) and clear (CL).

The cutter unit U3 includes a roller cutter 41 and is configured to cut the printing paper P1 or P2 into a given size (length) by moving the roller cutter 41 in the width direction at an appropriate position of the length of the printing paper P1 or P2 while rotating the roller cutter 41.

Disposed below the roller cutter 41 is a chip collecting box 65 for collecting chips of the printing paper P1 or P2 formed by the cutting. The chip collecting box 65 is configured so that the operator can slide it out of the housing 6 by pulling its handle 66 and take out the chips collected in it.

The piece of printing paper P1 or P2 cut by the cutter unit U3 is conveyed to the paper output unit U4 by a pair of conveyance rollers 43 engaged against each other. The back printing unit 4 is disposed between the cutter unit U3 and the paper output unit U4. In the back printing unit 4, a serial number or the like is printed on the back (underside) of the printing paper P1 or P2 passing through it.

The paper output unit U4 includes two pairs of output rollers 45 and 46 for conveying the piece of printing paper P1 or P2 and delivering it to the decurling unit U7.

The conveyance rollers 43 and the output rollers 45 and 46 are configured to be synchronously driven into rotation by an unshown electric motor. Furthermore, the later-described conveyance roller 81 and decurling roller 82 of the decurling unit U7 are likewise configured to be driven into rotation by the electric motor in synchronism with the conveyance rollers 43 and the output rollers 45 and 46. Note that both the conveyance roller 81 and the decurling roller 82 need not necessarily be driven into rotation and only one of both (preferably, only the conveyance roller 81) may be driven into rotation.

Furthermore, each pair of conveyance rollers 43 and output rollers 45 and 46 are configured to be disengaged one from the other before the leading edge of the printing paper P1 or P2 conveyed by the upstream conveyance drive roller 24 and print conveyance rollers 33 is pinched between the pair.

Specifically, when the printing paper P1 or P2 is conveyed from the conveyance drive roller 24 and the print conveyance rollers 33 towards the pair of conveyance rollers 43, the upper conveyance roller moves up and disengages from the lower conveyance roller before the leading edge of the printing paper P1 or P2 contacts the pair of conveyance rollers 43. Likewise, when the printing paper P1 or P2 having passed through the conveyance rollers 43 is conveyed towards each of the two pairs of output rollers 45 and 46, the upper roller of each pair of output rollers 45 and 46 moves up and disengages from the lower roller before the leading edge of the printing paper P1 or P2 contacts the pair of output rollers. This eliminates inconveniences, such as creases of the printing paper P1 or P2 formed owing to its leading edge lodging on the conveyance rollers 43 and the output rollers 45 and 46.

Furthermore, after the printing of an image in the print unit U2 and before the cutting of the printing paper P1 or P2 in the cutter unit U3, the upper rollers of the pair of conveyance rollers 43 and the pairs of output rollers 45 and 46, which have been moved up, are concurrently returned to their positions of engagement against the lower rollers, thereby pinching the printing paper P1 or P2. This prevents the printing paper P1 or P2 from being displaced when being cut, which ensures accurate paper cutting.

Figure 6:
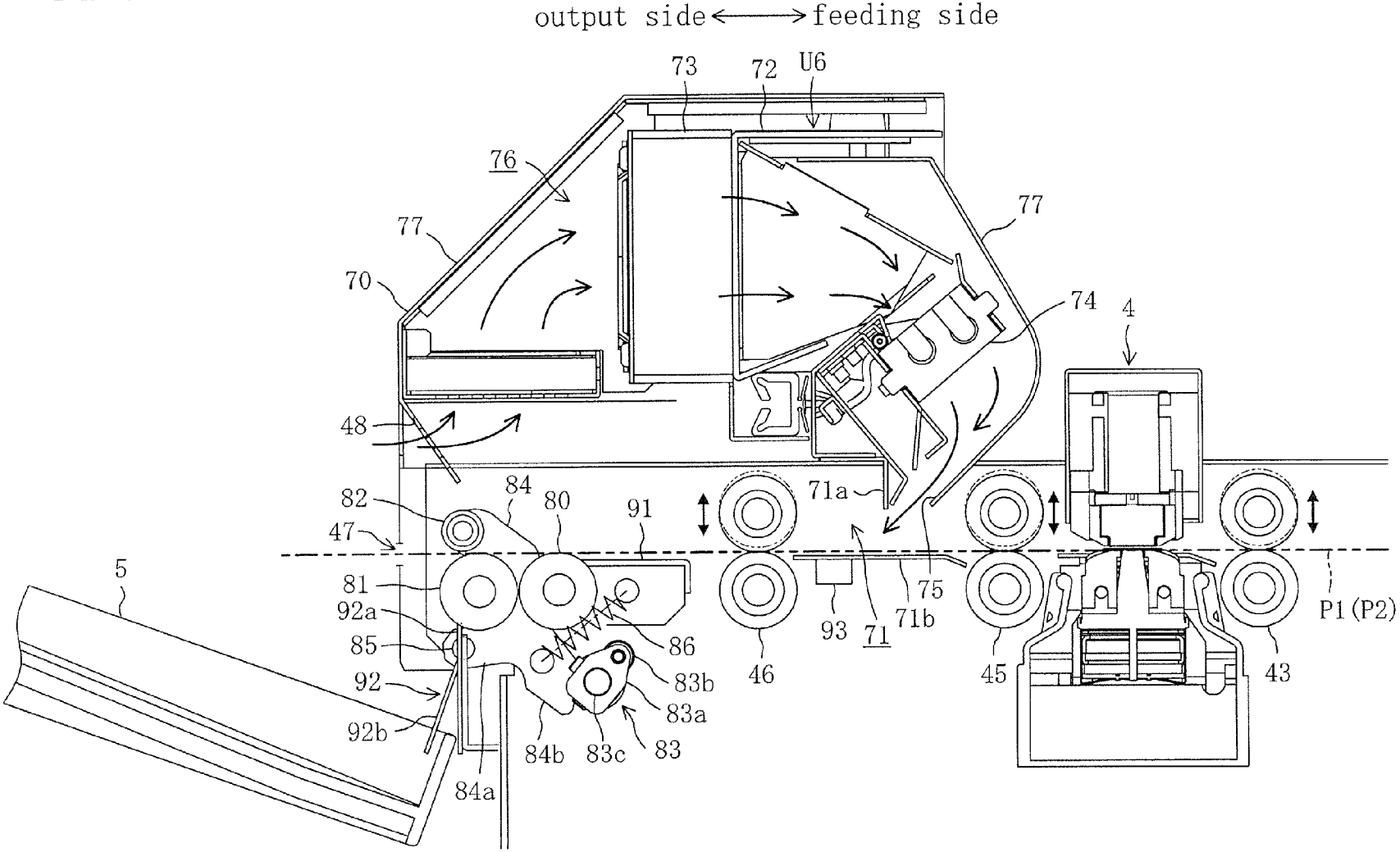
FIG. 6 is a cross-sectional view showing the structure of a drying unit and the decurling unit when viewed from the left of the housing.

The drying unit U6 is, as shown in FIG. 6, disposed between two pairs of engageable rollers in the paper output unit U4, i.e., between the pair of upstream output rollers 45 and the pair of downstream output rollers 46. The drying unit U6 is configured to suck air into the housing 6 through an air inlet 48 formed in the housing 6 above and in the vicinity of the paper output port 47, apply heat to the sucked air and blow out the air as dry air.

The drying unit U6 includes a drying chamber 71 disposed on the paper conveyance path of the printing paper P1 or P2, a dryer 72 for supplying dry air to the drying chamber 71 and an outside cover 70 for introducing the air sucked in the housing 6 through the air inlet 48 to the dryer 72. The drying chamber 71 is defined by an upper partition wall 71*a* and a lower partition wall 71*b* that are opposed to each other with the printing paper P1 or P2 therebetween, and constitutes a retention space for retaining dry air blown against the printing paper P1 or P2 from the dryer 72.

The dryer 72 includes a plurality of intake fans 73 disposed in the housing 6 at laterally spaced intervals to take air from the outside through the air inlet 48 of the housing 6 into the dryer 72, a heater 74 for heating the air taken in by the intake fans 73, and an exhaust nozzle 75, disposed at the lower end of the dryer 72, for blowing dry air heated by the heater 74 therethrough to the printing paper P1 or P2. The exhaust nozzle 75 opens at the bottom of the dryer 72 and downstream in the direction of paper conveyance and is configured to blow dry air down and downstream in the direction of paper conveyance. The dry air is used to dry ink adhering to the printing surface of the printing paper P1 or P2 in the printing part 2.

The outside cover 70 is disposed above the paper output port 47 of the housing 6 and configured to allow air sucked in the housing 6 through the air inlet 48 to flow through a flow space 76 located in the outside cover 70 and introduce the air to the intake fans 73. The outside cover 70 has an openable and closable rear door formed in the surface thereof. Since such a drying unit U6 is provided, the blow of dry air promotes the drying of ink ejected from the print head H to the printing paper P1 or P2 even if the ink on the printed piece of paper is not yet dried.

-Decurling Unit-

Next, a description is given of the structure of the decurling unit U7. As shown in FIG. 6, the decurling unit U7 (i.e., the later-described roller pair composed of a conveyance roller 81 and a decurling roller 82) is disposed at the terminal end of the paper conveyance path provided in the housing 6 of the printer body 90 and in the vicinity of the paper output port 47 in the housing 6 (on the downstream side of the dryer 72) and configured to output a piece of printing paper P1 or P2, which has been conveyed to the terminal end of the conveyance path, from the terminal end through the paper output port 47 to the paper output tray 5. The paper output tray 5 is disposed below the terminal end of the paper conveyance path (the paper output port 47), whereby a level difference is produced between the paper output tray 5 and the terminal end of the paper conveyance path.

In addition, the decurling unit U7 has the function of performing a decurling process of correcting the curl of a paper web P2 that is a core set formed by rolling the paper web P2 around the core (i.e., a curl of the paper web P2 curving with the back inside), and includes a roller pair composed of a conveyance roller 81 (corresponding to a first roller) and a decurling roller 82 (corresponding to a second roller) and a position changing element 83 for changing the relative position of the decurling roller 82 to the conveyance roller 81. Furthermore, a free roller 80 is disposed upstream of the conveyance roller 81 to rotate in conjunction with the movement of the piece of printing paper P1 or P2 being conveyed.

Figure 7:
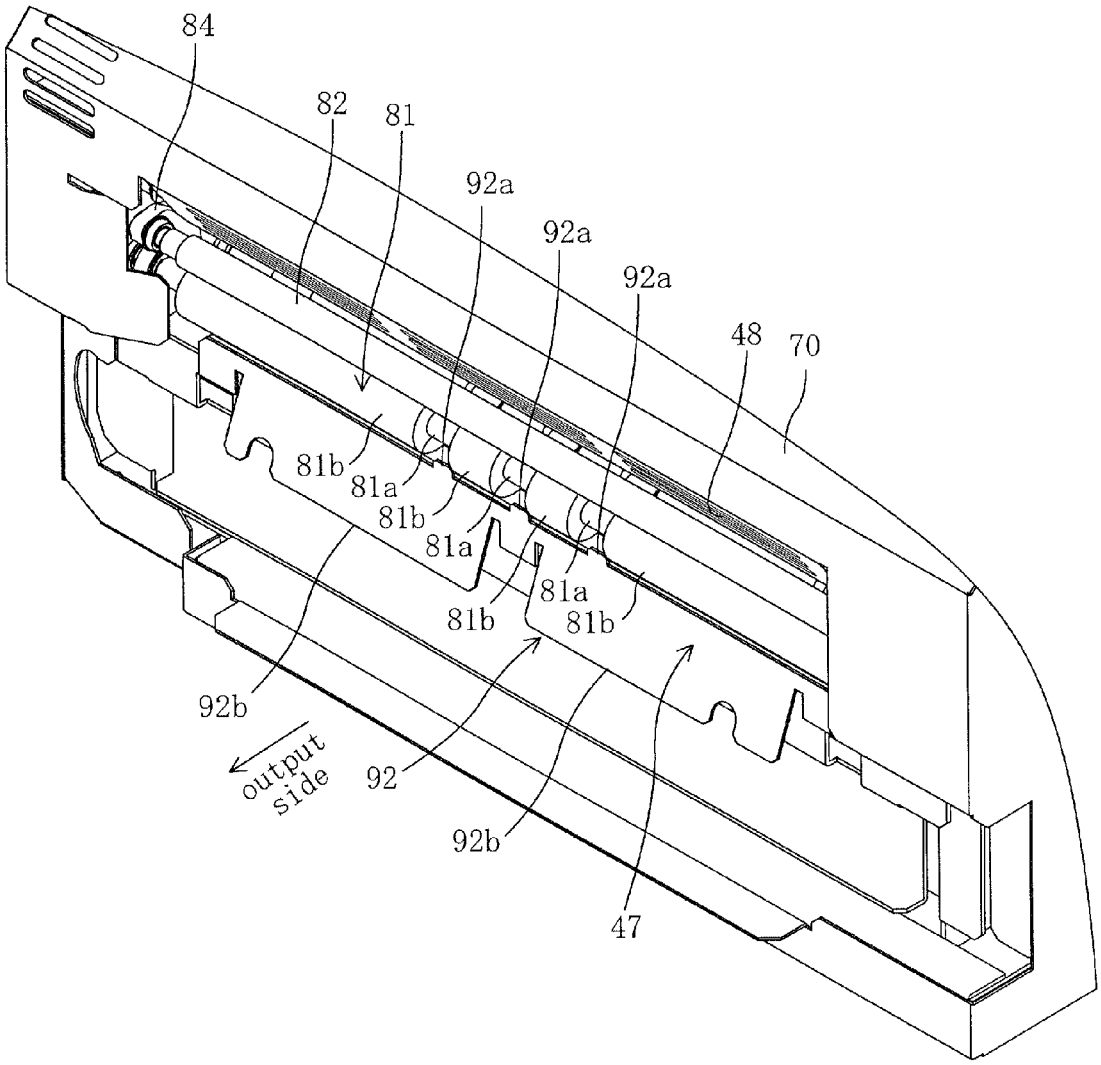
FIG. 7 is a perspective view showing the structure of the inkjet printer around a paper output port when viewed from the front of the housing.
Figure 8:
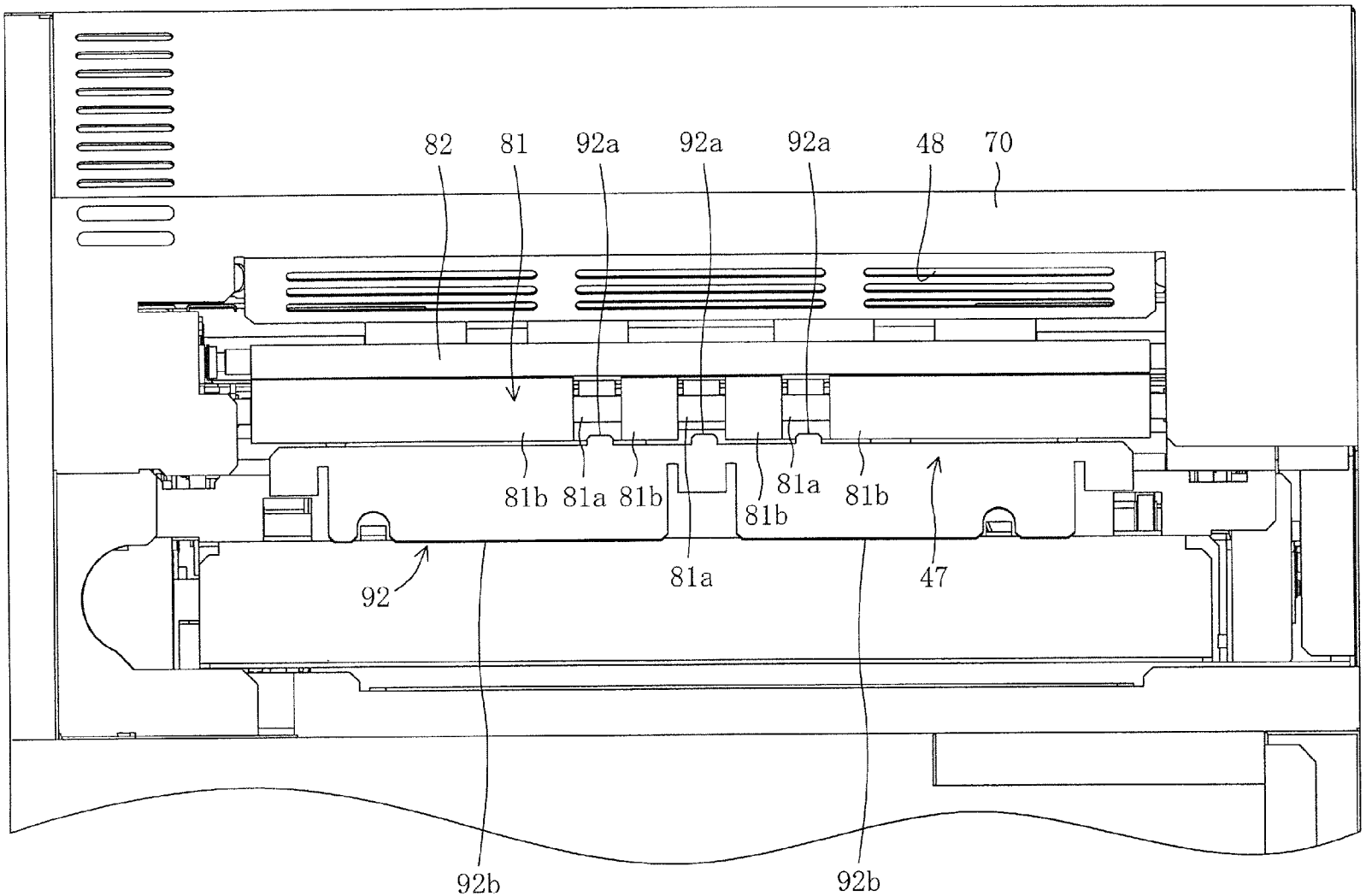
FIG. 8 is a front view showing the structure of the inkjet printer around the paper output port when viewed from the front of the housing.

The conveyance roller 81 is, as shown in FIGS. 7 and 8, composed of a roller shaft 81*a* extending in the width direction of the printing paper P1 or P2 and a plurality of roller bodies 81*b*, 81*b*, . . . arranged at spaced intervals in the axial direction of the roller shaft 81*a*.

Disposed on the downstream side of the conveyance roller 81 is a guide member 92 for smoothly feeding the piece of printing paper P1 or P2 output from the conveyance roller 81 towards the paper output tray 5 while guiding the trailing edge thereof to prevent it from being caught by the conveyance roller 81. The guide member 92 includes a pair of laterally arranged guide plates 92*b* and 92*b*, extending in the axial direction of the conveyance roller 81 to cover the lower edge of the conveyance roller 81, for guiding the piece of printing paper P1 or P2 to the paper output tray 5, and projections 92*a*, 92*a*, . . . , projecting from the upper edge of the guide plates 92*b* and 92*b* to come between each adjacent roller bodies 81*b* and 81*b*, for guiding the trailing edge of the piece of printing paper P1 or P2 against being caught between each adjacent roller bodies 81*b* and 81*b*.

The decurling roller 82 has a smaller diameter than the conveyance roller 81, extends continuously in the width direction of the printing paper P1 or P2 and is disposed travelably substantially along the roller surface of the conveyance roller 81 (the outer peripheries of the roller bodies 81*b*). As described later, a decurling position, a conveyance position and a pinch release position are set on the traveling path of the decurling roller 82. The decurling roller 82 is changed to these plural positions.

Specifically, a shaft end of the decurling roller 82 is rotatably attached to a lever 84. The lever 84 includes an attachment part 84*a* having a general shape of the letter C to surround the upstream side of the conveyance roller 81 when viewed in the axial direction of the roller shaft 81*a* (in the width direction of the printing paper P1 or P2) and an abutment part 84*b* extending upstream and obliquely downward from the upstream side of the lower end of the attachment part 84*a*. The decurling roller 82 is rotatably attached to the upper distal end of the generally C-shaped attachment part 84*a*, while a lever shaft 85 is attached to the lower distal end thereof. The decurling roller 82 is configured to circularly move substantially along the roller surface of the conveyance roller 81 by pivotally moving the lever 84 about the lever shaft 85.

Furthermore, a bias spring 86 is anchored to the abutment part 84*b* of the lever 84 and an attachment bracket 91 disposed to the upstream side of the free roller 80 to urge the lever 84 towards rotating counterclockwise in FIG. 6 and putting the decurling roller 82 into the later-described pinch release position.

Disposed on the upstream side of the lever 84 is the position changing element 83 for pressing the lever 84 while abutting on the abutment part 84*b* to rotate the lever 84 clockwise against the urging force of the bias spring 86. The position changing element 83 includes a body 83*a* pivotable about a pivot shaft 83*c* extending in the width direction of the printing paper P1 or P2 and a roller 83*b* rotatably attached to the upper end of the body 83*a* and capable of abutting on the abutment part 84*b*. The body 83*a* is configured to be pivotally moved about the pivot shaft 83*c* by an unshown pulse motor.

Furthermore, the position changing element 83 is configured to change the relative position of the decurling roller 82 to the conveyance roller 81 by changing its angle of rotation while allowing its roller 83*b* to abut on the abutment part 84*b* of the lever 84.

Figure 9:
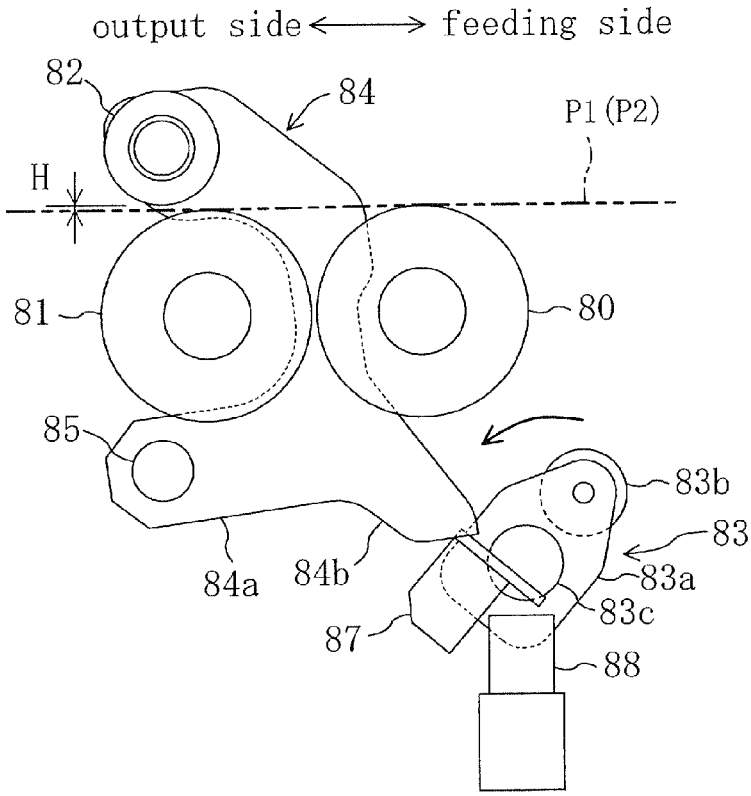
FIG. 9 is a side view of the decurling unit when a decurling roller is positioned in a pinch release position.

More specifically, as shown in FIG. 9, when the roller 83*b* of the position changing element 83 is not allowed to abut on the abutment part 84*b* of the lever 84, the lever 84 is positioned in the pinch release position, which is the leftmost position (the most downstream position), by the urging force of the bias spring 86. In the pinch release position, the decurling roller 82 is out of touch with the conveyance roller 81 on the opposite side of the paper conveyance path to the conveyance roller 81 (above the conveyance roller 81), whereby a given clearance H (larger than the thickness of the printing paper P1 or P2) is created between the conveyance roller 81 and the decurling roller 82 and the pinch of the printing paper P1 or P2 (roller engagement) is released. Thus, in the pinch release position, the printing paper P1 or P2 cannot be conveyed. Furthermore, in the pinch release position, the axis of rotation of the decurling roller 82 is located closer to the paper output side than (downstream from) the axis of rotation of the conveyance roller 81. A detection lug 87 is attached to the body 83*a* of the position changing element 83. When the detection lug 87 deviates to the left from a transmission sensor 88 as shown in FIG. 9, it is detected that the decurling roller 82 is positioned in the pinch release position.

With the above configuration, the pinch of the printing paper P1 or P2 between the conveyance roller 81 and the decurling roller 82 can be released. For example, when the paper conveyance is temporarily stopped owing to intermittent paper conveyance in order to form an image on the paper, the pressing of the decurling roller 82 against a paper web P2 is released by moving the decurling roller 82 in decurling process from the later-described decurling position to the pinch release position. Thus, an inconvenience can be eliminated that an indentation of the decurling roller 82 is left on the paper web P2.

Figure 10:
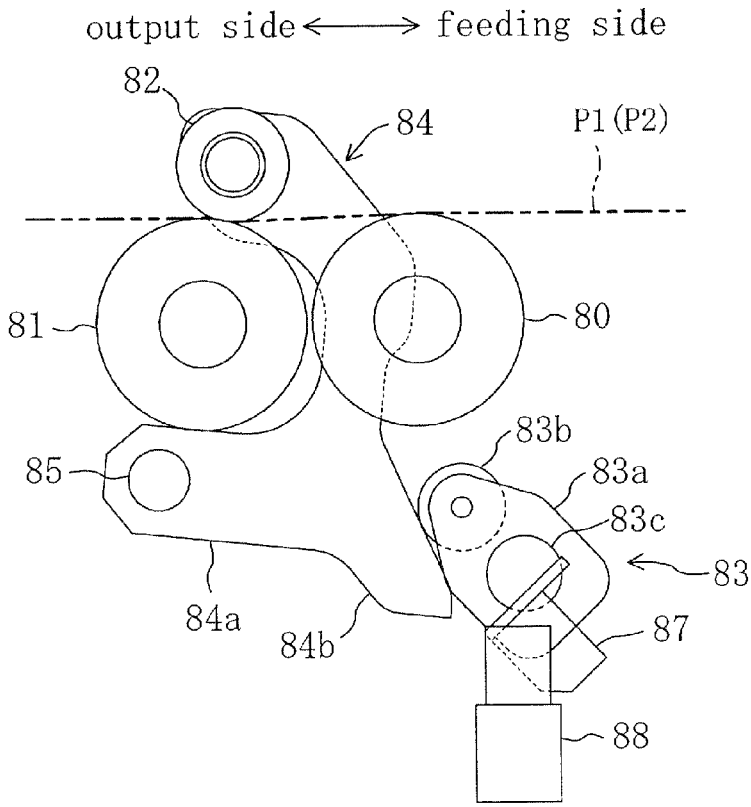
FIG. 10 is a side view of the decurling unit when the decurling roller is positioned in a conveyance position.

Next, as shown in FIG. 10, the body 83*a* of the position changing element 83 is pivotally moved counterclockwise to press the roller 83*b* against the abutment part 84*b* of the lever 84 until the transmission sensor 88 detects the detection lug 87. Thus, the lever 84 is pivotally moved clockwise against the urging force of the bias spring 86 to position the decurling roller 82 in the conveyance position in which the decurling process is disabled and a paper sheet P1 is conveyed. In the conveyance position, the paper sheet P1 is pinched between the conveyance roller 81 and the decurling roller 82 and both the rollers 81 and 82 are driven into rotation, whereby the paper sheet P1 is delivered to the paper output tray 5. Furthermore, in the conveyance position, the decurling roller 82 is positioned slightly upstream from the conveyance roller 81. In other words, the axis of rotation of the conveyance roller 81 is located closer to the paper output side than the axis of rotation of the decurling roller 82. Furthermore, in the conveyance position, the paper sheet P1 is never bent along the roller surface of the decurling roller 82. Even if a paper web P2 is conveyed in the conveyance position, the paper web P2 is not bent along the roller surface of the decurling roller 82 and, therefore, it cannot be decurled.

Since the decurling roller 82 is positioned slightly upstream from the conveyance roller 81, a greater clearance is created between both the conveyance roller 81 and the decurling roller 82 than the case where both the rollers 81 and 82 are vertically juxtaposed with respect to the paper conveyance direction (but it is smaller than the thickness of the paper sheet P1). Thus, the pinching force of the rollers 81 and 82 against the paper sheet P1 can be reduced to reduce the load applied to the paper sheet P1. Specifically, the paper sheet P1 is conveyed in a slightly sagging state. Therefore, even if the pinching force is reduced, the restoring force of the paper sheet P1 towards stretching straight and the frictional force between the paper sheet P1 and the pair of rollers 81 and 82 provide smooth conveyance of the paper sheet P1 using the resilience of the paper sheet P1. However, the arrangement of the conveyance roller 81 and the decurling roller 82 is not limited to the above. Both the rollers 81 and 82 may be vertically juxtaposed with respect to the paper conveyance direction. In short, it will suffice if the paper sheet P1 can be conveyed without being subjected to the decurling process.

In the conveyance position, the clearance between both the rollers 81 and 82 is smaller than the thickness of the paper sheet P1. However, when both the rollers 81 and 82 pinch the paper sheet P1, at least the roller surface of the conveyance roller 81 deforms so that the clearance between both the rollers 81 and 82 becomes equal to the thickness of the paper sheet P1.

Figure 11:
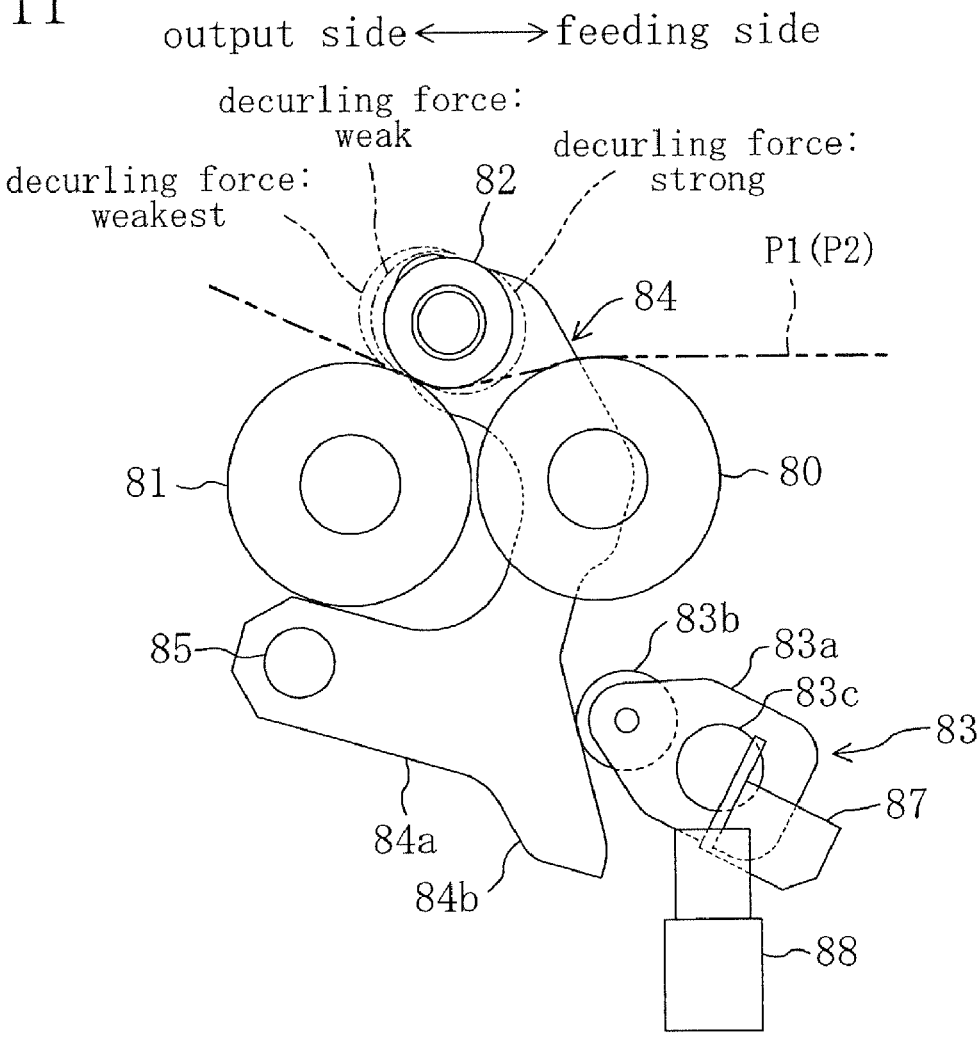
FIG. 11 is a side view of the decurling unit when the decurling roller is positioned in a decurling position.

Then, as shown in FIG. 11, the body 83*a* of the position changing element 83 is further pivotally moved counterclockwise to press the roller 83*b* against the abutment part 84*b* until the detection lug 87 deviates to the right from the transmission sensor 88 and is not detected by it. Thus, the decurling roller 82 is positioned in the decurling position in which the decurling process is enabled and a piece of paper web P2 is conveyed. In the decurling position, the axis of rotation of the decurling roller 82 is located upstream from the axis of rotation of the conveyance roller 81 and the decurling roller 82 moves towards the conveyance roller 81 (below) beyond the paper conveyance path. Thus, the decurling roller 82 presses down the piece of paper web P2 to bend it along the roller surface of the decurling roller 82 with its printing surface inside, thereby decurling the piece of paper web P2. Furthermore, in the same manner as in the conveyance position, the piece of paper web P2 is pinched between the conveyance roller 81 and the decurling roller 82 and both the rollers 81 and 82 are driven into rotation, whereby the piece of paper web P2 is delivered to the paper output tray 5. In the decurling position, like in the conveyance position, the axis of rotation of the conveyance roller 81 is located closer to the paper output side than the axis of rotation of the decurling roller 82. However, in the decurling position, the distance between both the axes of rotation along the conveyance direction is larger than that in the conveyance position.

In this case, the clearance between the decurling roller 82 and the conveyance roller 81 when the decurling roller 82 is in the decurling position is set to be larger than that when the decurling roller 82 is in the conveyance position. Specifically, the clearance between the decurling roller 82 and the conveyance roller 81 is set to be larger than the thickness of the paper web P2 when the decurling roller 82 is in the decurling position, while the clearance is set to be smaller than the thickness of the paper web P2 (and the thickness of the paper sheet P1) when the decurling roller 82 is in the conveyance position.

Thus, in moving the decurling roller 82 from the conveyance position to the decurling position, the clearance is gradually changed, which prevents a strong pressing force from rapidly acting on the restoring force of the piece of paper web P2 towards stretching straight and minimizes damage to the piece of paper web P2.

A plurality of decurling positions are set substantially along the roller surface of the conveyance roller 81 (and shown in the imaginary lines in FIG. 11). In an example shown in FIG. 11, the position of the decurling roller 82 shown in the solid line is a reference decurling position, the position of the decurling roller 82 moved clockwise from the reference position is a strong decurling position where the decurling force of the decurling roller 82 (the pressing force thereof against the paper web P2) is strong, the position of the decurling roller 82 moved counterclockwise from the reference position is a weak decurling position where the decurling force is weak, and the position of the decurling roller 82 further moved counterclockwise from the weak decurling position is a weakest decurling position where the decurling force is weakest. The position changing element 83 adjusts the strength of the decurling force to the paper web P2 by moving the decurling roller 82 among the plural decurling positions from the weakest to the strong decurling position.

With the above configuration, an appropriate decurling force to the shape of a curl of the piece of paper web P2 can be applied to the piece of paper web P2. Specifically, part of the paper web P2 in the vicinity of the core around which the paper web P2 is rolled has a small radius of curvature and is therefore strongly curled, while part of the paper web P2 in the vicinity of the outer periphery thereof has a large radius of curvature and is therefore weakly curled. To cope with this, the strength of the decurling force is adjusted according to the amount of use of the rolled paper web P2 contained in the paper roll containing part 1. Thus, the curl of each piece of the paper web P2 can be corrected with an optimum decurling force. Specifically, at an initial stage of use, the paper web P2 is determined to be weakly curled and, therefore, the decurling roller 82 is set to the weakest decurling position. At a middle stage of use, the decurling roller 82 is set to the weak decurling position. At a late stage of use, the decurling roller 82 is set to the strong decurling position.

Furthermore, when the length of a piece of paper web P2 cut in a given length by the cutter unit U3 is larger than a predetermined value, the decurling force to the cut piece of paper web P2 may be set to be stronger than when the length of a cut piece of paper web P2 is equal to or smaller than the predetermined value. In other words, such a long cut piece of paper web P2 is determined to be more flexible and more strongly curled and, therefore, a strong decurling force is applied to it. Alternatively, the decurling force applied to the piece of paper web P2 may be set to be larger as the piece of paper web P2 becomes longer.

Furthermore, the decurling force applied to the piece of paper web P2 may be adjusted according to the material of the paper web P2. In this case, an appropriate decurling force with which the piece of paper web P2 can be easy to decurl is applied to the piece of paper web P2 according to its material, such as by setting a strong decurling force for the paper web P2 made of a hard material having a strong elasticity.

Alternatively, for example, information on the date of production of the paper web P2 may be stored in a memory, such as an IC chip, provided in the core for the paper web P2 and the strength of the decurling force applied to each cut piece of the paper web P2 may be adjusted according to the number of days elapsed from the data of production by reading the information on the date of production. Specifically, if the number of days elapsed from the date of production, having been read from the memory for the paper web P2, is over a predetermined number of days, the cut piece of paper web P2 is determined to be strongly curled and the decurling force is set to be strong.

In the first example embodiment, the position changing element 83 and the lever 84 constitute a roller position changing mechanism for changing the decurling roller 82 among the decurling position, the conveyance position and the pinch release position.

As shown in FIG. 6, the under surface of a lower partition wall 71*b* defining part of the drying chamber 71 of the drying unit U6 has a detection sensor 93 provided on a downstream part thereof to detect the leading edge and trailing edge of a piece of printing paper P1 or P2. When the detection sensor 93 detects the leading edge of the piece of printing paper P1 or P2, the piece of printing paper P1 or P2 is conveyed a predetermined length from the point in time of detection until the leading edge of the piece of printing paper P1 or P2 reaches a point corresponding to the conveyance roller 81 and, then, the decurling roller 82 of the decurling unit U7 is moved from the pinch release position to the decurling position or conveyance position. Specifically, the decurling roller 82 stands by at the pinch release position as described later, so that the conveyance roller 81 and the decurling roller 82 can smoothly pinch the piece of printing paper P1 or P2 when the piece of printing paper P1 or P2 is transferred from the paper output unit U4 to the decurling unit U7. This eliminates inconveniences, such as creases of the piece of printing paper P1 or P2 formed owing to its leading edge lodging on the conveyance roller 81 and the decurling roller 82.

On the other hand, when the detection sensor 93 detects the trailing edge of the piece of printing paper P1 or P2, the piece of printing paper P1 or P2 is conveyed a predetermined length from the point in time of detection until the trailing edge of the piece of printing paper P1 or P2 reaches a point between the free roller 80 and the conveyance roller 81 and, then, the decurling roller 82 of the decurling unit U7 is moved from the decurling position or conveyance position to the pinch release position. In other words, when the trailing edge of the piece of printing paper P1 or P2 is sent out to the paper output tray 5 in the course of output of the piece of printing paper P1 or P2 to the paper output tray 5 by means of the conveyance roller 81 and the decurling roller 82 being in the decurling position or the conveyance position, the decurling roller 82 is switched from the decurling position or the conveyance position to the pinch release position.

Thus, in conjunction with movement of the decurling roller 82 from the decurling position or the conveyance position to the pinch release position, the trailing edge of the piece of printing paper P1 or P2 is moved at a stroke to the paper output tray 5. Therefore, the output speed of the piece of printing paper P1 or P2 increases, which provides smooth transfer of the piece of printing paper P1 or P2 to the paper output tray 5 and stabilizes the placement point of pieces of printing paper P1 or P2 on the paper output tray 5. Specifically, a level difference exists between the paper output tray 5 and the terminal end of the paper conveyance path and, therefore, the leading edge of the piece of printing paper P1 or P2 is likely to sag by gravity and is sent out while sliding on the top surface of the paper output tray 5 or the top surface of the piece of printing paper P1 or P2 already placed on it. In this case, after the trailing edge of the piece of printing paper P1 or P2 is output, the paper stop point, i.e., the paper placement point, is not fixed owing to the frictional resistance acting on the leading edge thereof. To cope with this, if the output speed of the piece of printing paper P1 or P2 is increased in sending out the trailing edge of the piece of printing paper P1 or P2, the paper placement point can be stabilized. On the other hand, the output speed of the piece of printing paper P1 or P2 is decreased in sending out the part thereof other than the trailing edge. Thus, the ink adhering to the printing surface of the piece of printing paper P1 or P2 can be certainly dried by the dryer 72 of the drying unit U6. Then, when the output of the piece of printing paper P1 or P2 is completed, the decurling roller 82 is positioned in the pinch release position. Therefore, the decurling roller 82 can stand by as it is until the leading edge of the next piece of printing paper P1 or P2 comes to the decurling roller 82. This eliminates the need to bother to change the decurling roller 82 to the pinch release position in transferring the next piece of printing paper P1 or P2.

Furthermore, when the trailing edge of the piece of printing paper P1 or P2 comes between the free roller 80 and the conveyance roller 81, i.e., when the trailing edge of the piece of printing paper P1 or P2 is sent out to the paper output tray 5 in the course of output of the piece of printing paper P1 or P2 to the paper output tray 5 by means of the conveyance roller 81 and the decurling roller 82 being in the decurling position or the conveyance position, the rotational speed of the electric motor driving the conveyance roller 81 and the decurling roller 82 is increased in addition to movement of the decurling roller 82 to the pinch release position. As a result, the rotational driving speed of the conveyance roller 81 and the decurling roller 82 is changed to their higher side, whereby the placement point of pieces of printing paper P1 or P2 on the paper output tray 5 can be further stabilized.

Furthermore, since the decurling unit U7 is disposed downstream of the dryer 72 to decurl the piece of paper web P2 just after being dried by the dryer 72, this is advantageous in appropriately correcting the curl of the piece of paper web P2. Specifically, the piece of paper web P2 heated by dry air from the dryer 72 is very likely to be deformed. Therefore, if the piece of paper web P2 in this state is decurled by the decurling unit U7, a higher decurling effect can be obtained than when the piece of paper web P2 is not heated.

As described so far, when a rolled paper web P2 is conveyed, the decurling unit U7 corrects the curl of each piece of the paper web P2 by moving the decurling roller 82 to the decurling position and subjecting the piece of paper web P2 to the decurling process. On the other hand, when a paper sheet P1 is conveyed, the decurling unit U7 conveys the paper sheet P1 to the paper output tray 6 without subjecting it to the decurling process by moving the decurling roller 82 to the conveyance position. In this manner, the decurling unit U7 selects whether or not to perform the decurling process depending upon the type of printing paper P1 or P2 being conveyed. Therefore, it can be avoided that the paper sheet P1 originally having no curl is subjected to the decurling process and thereby curled. As a result, the decurling unit U7 can appropriately handle a piece of rolled printing paper P2 and a sheet of printing paper P1.

Furthermore, when the paper conveyance is temporarily stopped owing to intermittent conveyance in order to form an image on the paper, the pressing of the decurling roller 82 against each piece of paper web P2 is released by moving the decurling roller 82 in decurling process from the decurling position to the pinch release position, whereby an indentation of the decurling roller 82 can be prevented from being left on the piece of paper web P2. This prevents deterioration of printing quality due to the indentation.

SECOND EXAMPLE EMBODIMENT

Figure 12:
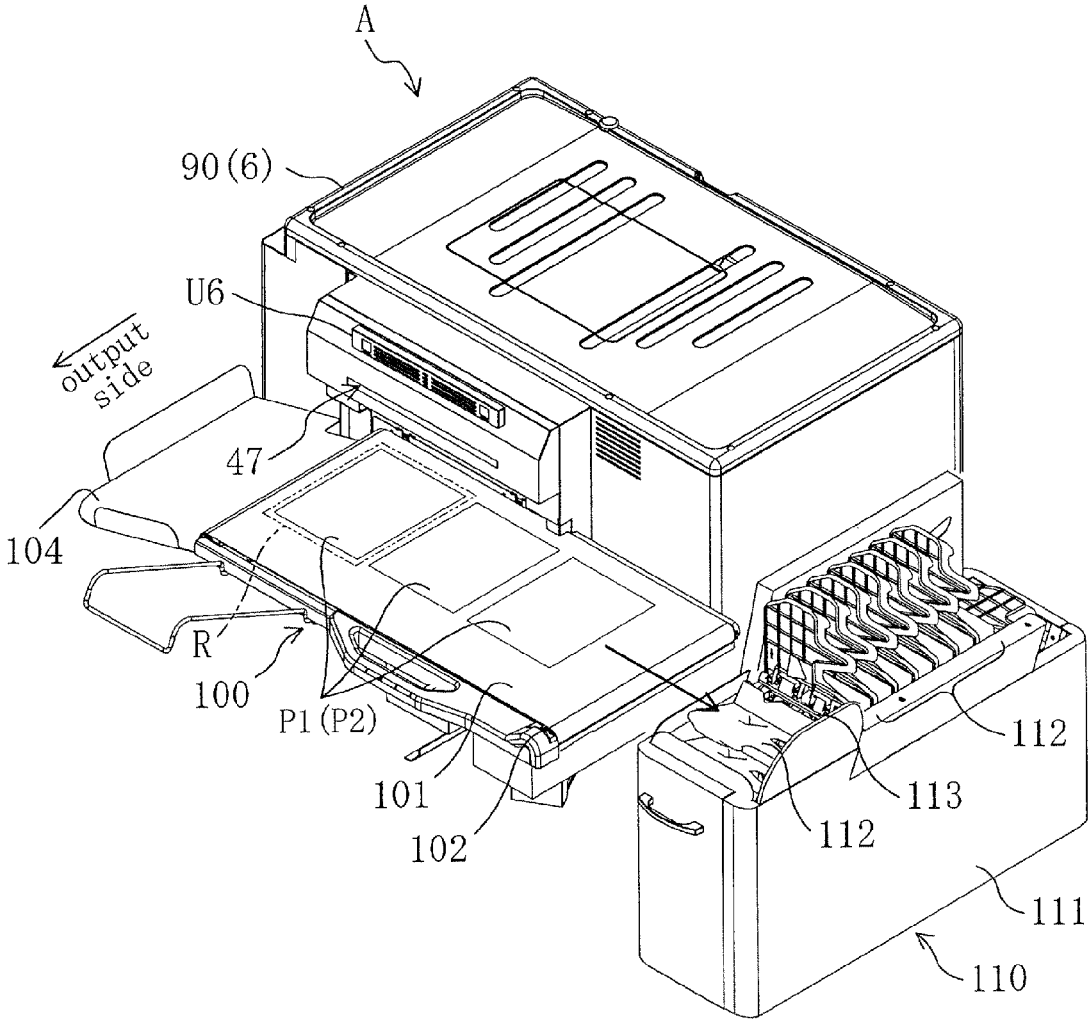
FIG. 12 is a perspective view showing the structure of an inkjet printer including a decurling unit according to a second example embodiment.

FIG. 12 is a perspective view showing the structure of an inkjet printer according to a second example embodiment. This example embodiment is different from the first example embodiment in that a conveyance unit 100 and an collection unit 110 are provided instead of the paper output tray 5. Therefore, the same parts are identified by the same reference numerals as in the first example embodiment and a description is given only of different points.

Figure 13:
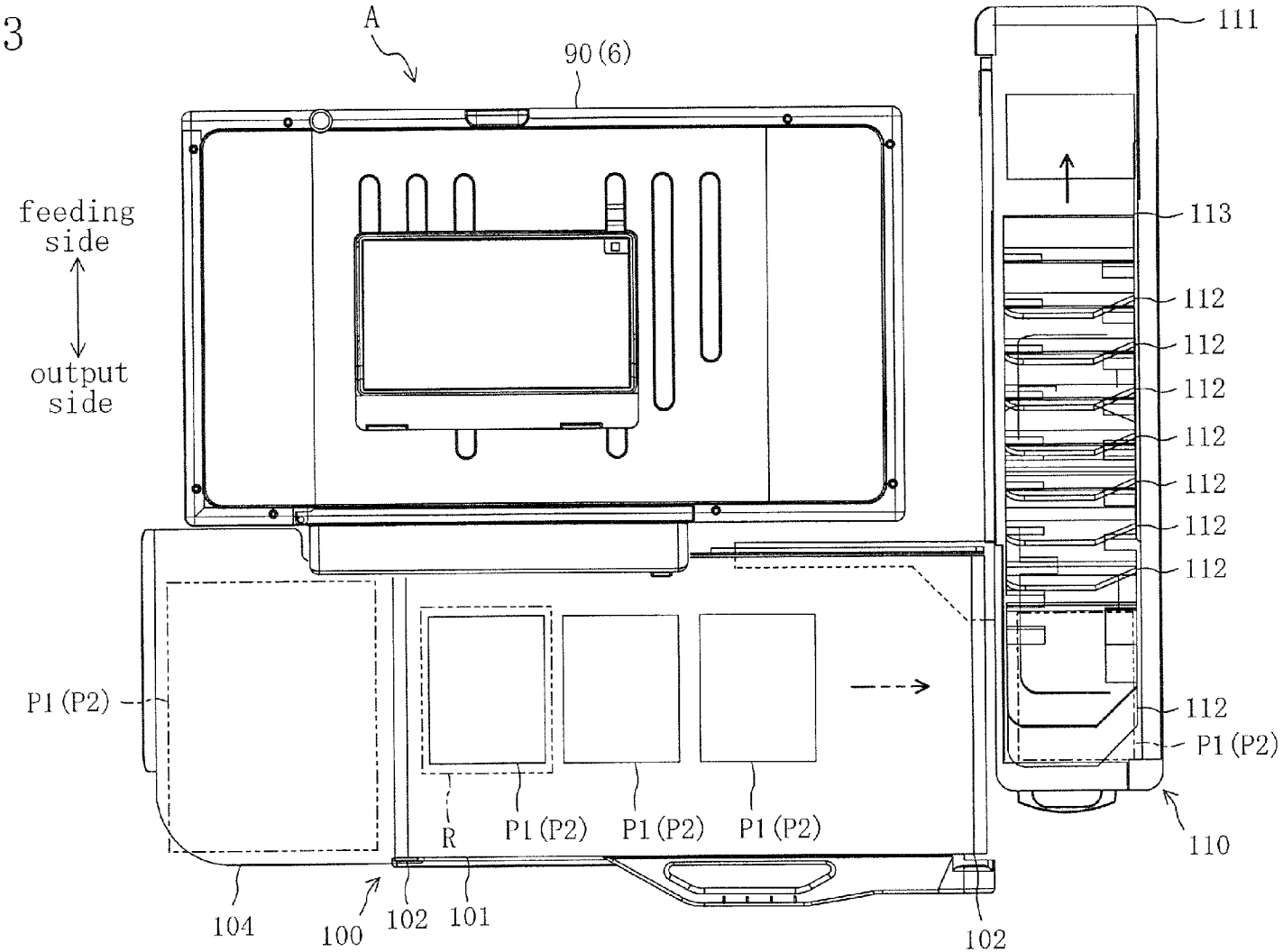
FIG. 13 is a plan view showing the structure of the inkjet printer according to the second example embodiment.

As shown in FIGS. 12 and 13, the inkjet printer A includes a printer body 90, a conveyance unit 100 disposed downstream of the printer body 90, and a collection unit 110 disposed downstream of the conveyance unit 100 in the direction of paper conveyance. The printer body 90 has substantially the same structure as described in the first example embodiment and, therefore, a description thereof is not given.

The conveyance unit 100 constitutes a paper placement part for receiving pieces of printing paper P1 or P2 output through the paper output port 47 in the housing 6 of the printer body 90 and placing them thereon and includes a conveying belt 101 for conveying pieces of printing paper P1 or P2 placed thereon downstream like a belt conveyer, a drive roller 102 for driving the conveying belt 101 and a large-sized tray 104 disposed upstream of the conveying belt 101 in the direction of paper conveyance. "Downstream of the conveyance unit 100 in the direction of paper conveyance" means to the right of the housing 6 (towards the collection unit 110).

The region of the conveying belt 101 corresponding to the paper output port 47 in the housing 6 is set to a placement region R where a piece of printing paper P1 or P2 just after being output through the paper output port 47 is received (strictly, this placement region R corresponds to the paper placement part). The placement region R of the conveying belt 101 is, like the paper output tray 5 in the first example embodiment, also disposed below the terminal end of the paper conveyance path provided in the interior of the housing 6 of the printer body 90 (below the paper output tray 47). Furthermore, the conveyance unit 100 is configured to control the movement of the conveying belt 101 to allow the already placed piece of printing paper P1 or P2 to leave the placement region R before the next piece of printing paper P1 or P2 to be output through the paper output port 47 in the housing 6 is placed on the placement region R.

Thus, pieces of printing paper P1 or P2 can be prevented from being stacked one after another, which prevents inconveniences, such as a phenomenon that ink on each printed piece of printing paper P1 or P2 is not uniformly dried to cause color shading of printed images.

The control on the movement of the conveying belt 101 is implemented by adjusting the speed of paper conveyance so that when the piece of printing paper P1 or P2 already placed on the placement region R leaves the placement region R, the next piece of printing paper P1 or P2 is output. Furthermore, instead of continuing to drive the conveying belt 101 at a constant speed, pieces of printing paper P1 or P2 may be intermittently conveyed so that the piece of printing paper P1 or P2 already placed on the placement region R can be conveyed at a stroke to the outside of the placement region R when the next piece of printing paper P1 or P2 is conveyed.

In this case, if a piece of printing paper P1 or P2 having a normal print size, such as L size, is placed on the conveying belt 101, the conveyance unit 100 is controlled to convey the piece of printing paper P1 or P2 to the collection unit 110 disposed downstream thereof in the direction of paper conveyance. On the other hand, if a piece of printing paper P1 or P2 having a large size is placed on the conveying belt 101, the conveyance unit 100 is controlled to convey the piece of printing paper P1 or P2 to the large-sized tray 104 disposed upstream thereof in the direction of paper conveyance. In this manner, by changing the direction of paper conveyance according to the size of piece of printing paper P1 or P2, pieces of printing paper P1 or P2 can be conveyed to appropriate accommodation sites for each paper size.

The collection unit 110 is disposed downstream of the conveyance unit 100 in the direction of paper conveyance and configured to collect pieces of printing paper P1 or P2 conveyed from the conveyance unit 100. The collection unit 110 includes a collecting body 111, a plurality of collecting plates 112, arranged at spaced intervals in the collecting body 111, for placing pieces of printing paper P1 or P2 conveyed from the conveyance unit 100 thereon, and a collecting belt 113 for conveying the plurality of collecting plates 112 towards the rear of the housing 6 like a belt conveyer.

Each collecting plate 112 stands by at a transfer point for pieces of printing paper P1 or P2 located downstream of the conveying belt 101 so that the plate surface is horizontal and substantially flush with the surface of the conveying belt 101. Then, when a predetermined number of pieces of printing paper P1 or P2 are stacked on the collecting plate 112 according to the print order, the collecting plate 112 is conveyed to the rear of the housing 6 by the collecting belt 113 before the next piece of printing paper P1 or P2 is conveyed according to the next print order. Then, the surface of the collecting plate 112 having been held horizontal stands up in the course of conveyance of the collecting belt 113 to function as a partition plate for partitioning pieces of printing paper P1 or P2 for each print order.

In this case, the conveyance unit 100 controls the movement of the conveying belt 101 so that when the piece of printing paper P1 or P2 is transferred from the conveying belt 101 to each collecting plate 112 of the collection unit 110, the speed of conveyance of the piece of printing paper P1 or P2 reaches a predetermined speed or more. Specifically, a clearance is left between the conveying belt 101 and the collecting plate 112 facing it. Therefore, if the speed of paper conveyance of the conveying belt 101 is too late, the edge of the piece of printing paper P1 or P2 may drop in the clearance, leading to failure of smooth paper transfer or failure of paper transfer. To avoid this, the speed of paper conveyance of the conveying belt 101 is controlled to be a speed at which the piece of printing paper P1 or P2 can be stably transferred, thereby ensuring the transfer of the piece of printing paper P1 or P2.

In this manner, by partitioning pieces of printing paper P1 or P2 with the collecting plates 112 for each print order, the pieces of printing paper P1 or P2 can be easily set in each order. Furthermore, since the number of pieces of printing paper P1 or P2 accommodated can be increased, the frequency with which the worker picks up pieces of printing paper P1 or P2 after being printed can be reduced, which increases the working efficiency.

Also in the second example embodiment, like the first example embodiment, a decurling unit U7 (a roller pair composed of a conveyance roller 81 and a decurling roller 82) is disposed at the terminal end of the paper conveyance path provided in the interior of the housing 6 of the printer body 90. The decurling unit U7 outputs pieces of printing paper P1 or P2 through the paper output port 47 in the housing 6 to the placement region R of the conveying belt 101. The decurling unit U7 has the same structure as in the first example embodiment. Therefore, like the first example embodiment, the decurling unit U7 can appropriately correct the curl of each piece of paper web P2 and can prevent a paper sheet P1 from being curled. Furthermore, the decurling roller 82 can be prevented from leaving an indentation on each piece of paper web P2, which prevents deterioration of printing quality due to the indentation.

Although in the above example embodiments the decurling unit U7 is disposed at the terminal end of the paper conveyance path provided in the interior of the housing 6 of the printer body 90, the location of the decurling unit U7 is not limited to this. Furthermore, although it is not necessarily needed to dispose the decurling unit U7 downstream of the dryer 72, the decurling unit U7 is preferably disposed downstream of the dryer 72 from the viewpoint of achievement of high decurling effect.

Furthermore, also in devices other than the inkjet printer A, the decurling unit U7 can be disposed on the paper conveyance path on which a curled piece of paper and a piece of paper with no curl are conveyed.

What is claimed is:

1. A decurling mechanism for performing a decurling process of correcting the curl of paper, the decurling mechanism comprising:

a first roller;

a second roller disposed travelably around the first roller; and a roller position changing mechanism for changing the second roller to a plurality of positions set on a traveling path of the second roller, the plurality of positions including a decurling position in which the decurling process to the paper is enabled and the paper is conveyed while being pinched between the first and second rollers, a conveyance position in which the decurling process to the paper is disabled and the paper is conveyed while being pinched between the first and second rollers and a pinch release position in which the paper is released from the pinch between the first and second rollers, wherein the second roller is located upstream of the first roller in a direction of paper conveyance when being in the conveyance position.

2. The decurling mechanism of claim 1, wherein the decurling position set on the traveling path of the second roller comprises a plurality of decurling positions, and the roller position changing mechanism is configured to adjust the strength of a decurling force applied to the paper by moving the second roller among the plurality of decurling position.

3. The decurling mechanism of claim 1, wherein the first and second rollers are disposed on a conveyance path for paper on which an image is to be printed in an inkjet printer, the inkjet printer includes a printing part for printing an image on the paper on the conveyance path by ejecting ink to the paper and a dryer, disposed downstream of the printing part in the direction of paper conveyance, for drying the ink adhering to the paper by blowing dry air to the paper after being printed by the printing part, and the first and second rollers are disposed downstream of the dryer in the direction of paper conveyance.

* * * * *

UNITED STATES PATENT AND TRADEMARK OFFICE

CERTIFICATE OF CORRECTION

PATENT NO. : 7,954,939 B2
APPLICATION NO. : 12/360696
DATED : June 7, 2011
INVENTOR(S) : Akihito Yamamoto and Yoshitsugu Tokai It is certified that error appears in the above-identified patent and that said Letters Patent is hereby corrected as shown below:

Title Page, Item (73) Assignee: should read as follows,

-- (73) Assignee: NK Works Co., Ltd. (JP) --.

Signed and Sealed this
Twenty-second Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,954,939 B2
APPLICATION NO. : 12/360696
DATED : June 7, 2011
INVENTOR(S) : Akihito Yamamoto and Yoshisugu Tokai It is certified that error appears in the above-identified patent and that said Letters Patent is hereby corrected as shown below:

(56) References Cited should read

FOREIGN PATENT DOCUMENTS

| | | |
|---|---|---|
| JP | 2006-056655 A | 3/2006 |

Signed and Sealed this
Tenth Day of April, 2012

David J. Kappos

David J. Kappos
*Director of the United States Patent and Trademark Office*